US005816550A

United States Patent [19]

Watanabe et al.

[11] Patent Number: 5,816,550

[45] Date of Patent: Oct. 6, 1998

[54] SHELF MOUNTING ARRANGEMENTS FOR ELECTRONIC SHELF DISPLAYS OR SIMILAR ARTICLES

[75] Inventors: Noboru Watanabe, Samukawa-machi; Toshiaki Yamai, Hiratuka, both of Japan

[73] Assignee: NCR Corporation, Dayton, Ohio

[21] Appl. No.: 681,005

[22] Filed: Jul. 22, 1996

Related U.S. Application Data

[63] Continuation of Ser. No. 233,188, Apr. 26, 1994, abandoned.

[30] Foreign Application Priority Data

Apr. 26, 1993 [JP] Japan ..... 5-120456

[51] Int. Cl.[6] ..... G09F 3/20

[52] U.S. Cl. ..... 248/222.11; 40/5; 40/653; 40/657; 248/231.21; 248/242; 248/274.1

[58] Field of Search ..... 248/231.21, 231.81, 248/225.11, 222.11, 221.11, 222.12, 274.1, 558, 220.21, 242; 40/5, 642, 653, 655, 657, 658

[56] References Cited

U.S. PATENT DOCUMENTS

| | | | |
|---|---|---|---|
| 2,103,485 | 12/1937 | Meyer | 248/274 |
| 3,015,177 | 1/1962 | Hembd et al. | 248/222.1 X |
| 3,889,408 | 6/1975 | Offner | 40/642 |
| 4,556,183 | 12/1985 | Greenberger | 248/221.4 |
| 4,881,707 | 11/1989 | Garfinkle | 248/221.4 |
| 5,044,104 | 9/1991 | Hopperdietzel | 40/642 |
| 5,375,357 | 12/1994 | Butcher et al. | 40/642 |

FOREIGN PATENT DOCUMENTS

| | | | |
|---|---|---|---|
| 648368 | 6/1964 | Belgium | 40/642 |
| 176921 | 10/1961 | Sweden | 248/242 |
| 2207539 | 2/1989 | United Kingdom | 40/642 |
| 93/19448 | 9/1993 | WIPO | 40/642 |

*Primary Examiner*—Leslie A. Braun
*Assistant Examiner*—Derek J. Berger
*Attorney, Agent, or Firm*—Craig E. Miller

[57] ABSTRACT

Shelf mounting arrangements for electronic shelf displays or similar articles including electronic shelf display mounting devices for mounting electronic shelf displays onto showcase shelves and similar surfaces. In a preferred embodiment of the present invention, the electronic shelf display mounting device generally includes a shelf mounting member and an electronic shelf display mounting member. The shelf mounting member includes upper and lower mounting legs, an engaging portion having slits formed at different angles and a fixing portion for fixing the mounting legs to the shelf. The electronic shelf display mounting member includes a connecting portion having engaging projections for engagement with the appropriate slits in the shelf mounting member and an electronic shelf display mounting portion for fixing the electronic shelf displays in position. The electronic shelf display mounting member is connected and fixed to the shelf mounting member by fitting the engaging projections into the corresponding slits formed in the shelf mounting member to provide the desired angle of elevation of the electronic shelf display. This angle of elevation may be readily changed by changing the corresponding slits of the shelf mounting member into which the engaging projections of the electronic shelf display mounting member are inserted. Furthermore, the shelf mounting member can have upper and lower mounting legs of different lengths so the shelf mounting member is capable of being turned over to provide additional elevational angles for mounting the electronic shelf displays to the shelves.

5 Claims, 6 Drawing Sheets

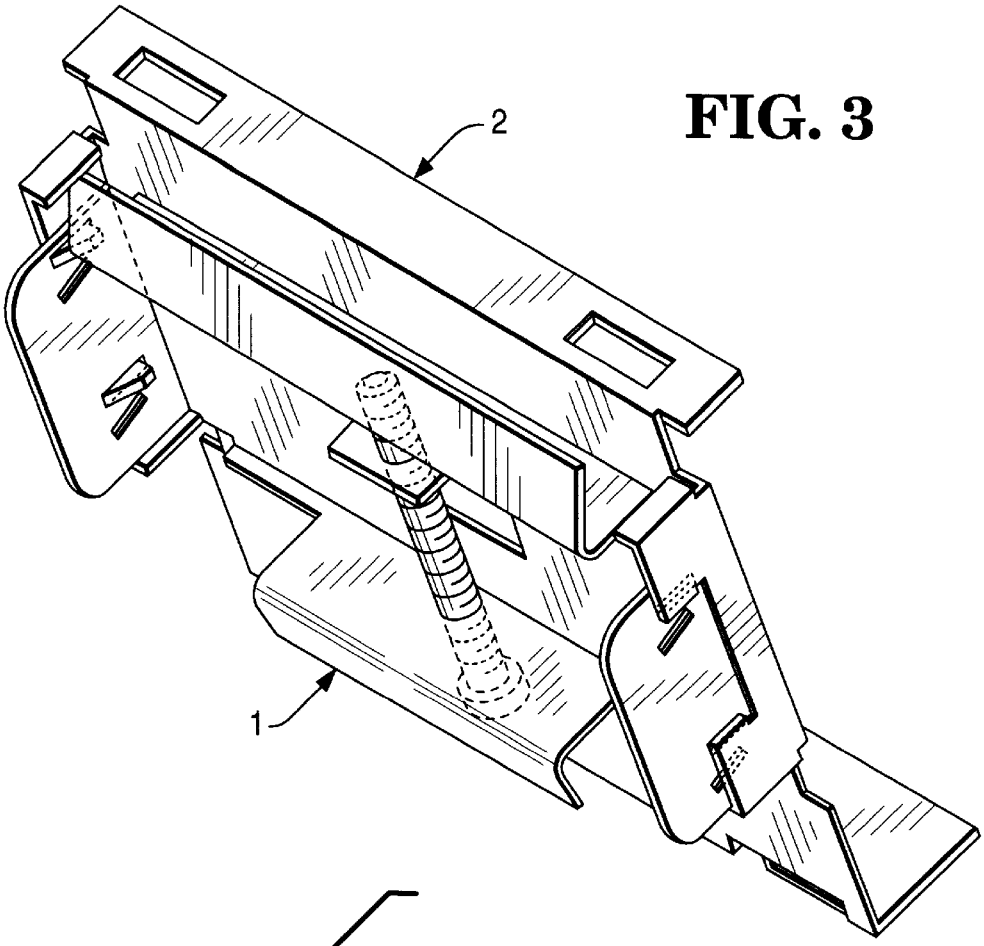
FIG. 3
FIG. 5
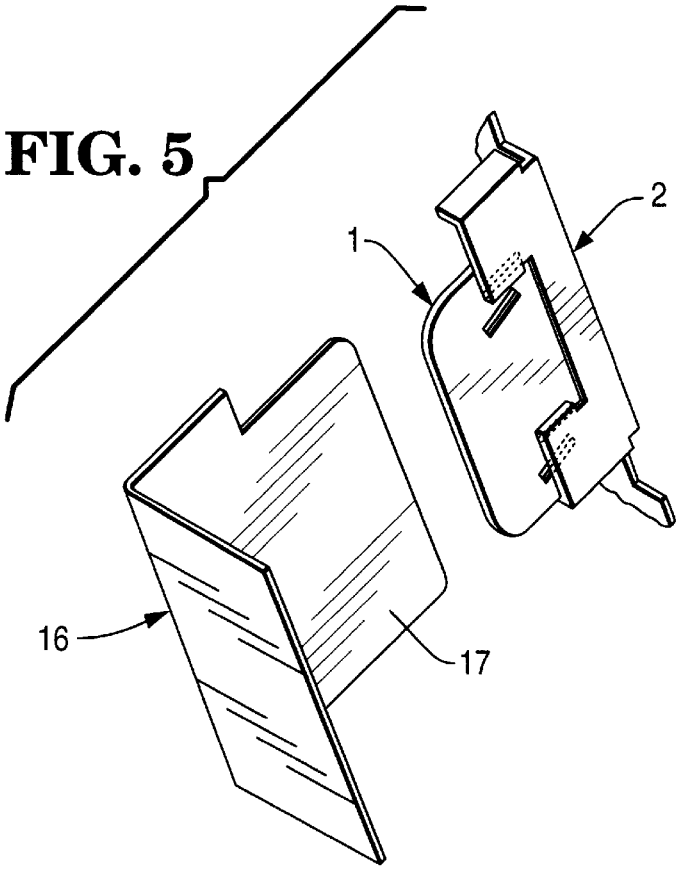

FIG. 7
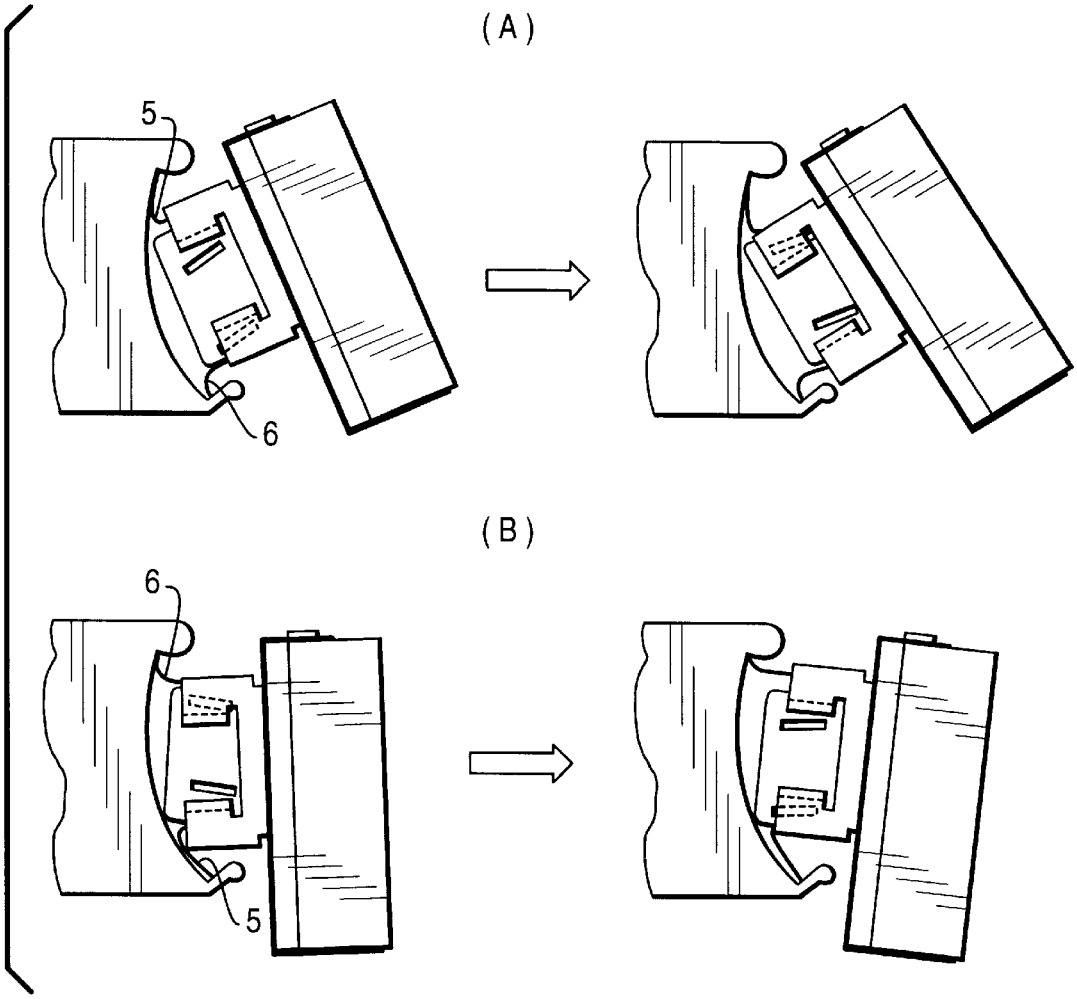
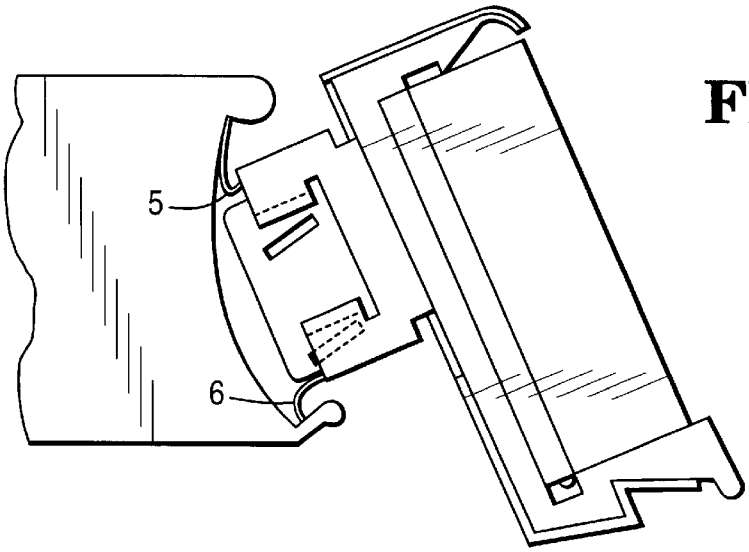
FIG. 8

SHELF MOUNTING ARRANGEMENTS FOR ELECTRONIC SHELF DISPLAYS OR SIMILAR ARTICLES

This is a continuation of application Ser. No. 08/233,188 filed on Apr. 26, 1994 now abandoned.

BACKGROUND AND SUMMARY OF THE INVENTION

The present invention relates generally to new and novel improvements in shelf mounting arrangements for electronic shelf displays or similar articles. More particularly, the present invention relates to shelf mounting arrangements for mounting electronic shelf displays or similar articles to showcase shelves or similar surfaces in retail stores and similar environments for displaying product prices and other product information electronically.

In electronic shelf display systems, electronic price displays are typically arranged in showcases corresponding to products displayed therein. The product price and other product information are displayed on each corresponding electronic shelf display. The product price and other product information displayed on each electronic shelf display are controlled by a central computer. This typically allows the product price and other product information being displayed on the electronic shelf displays to be changed immediately, as necessary.

In such electronic shelf display systems, liquid crystal displays having a relatively narrow viewing angle are usually utilized. This makes it advantageous for the electronic shelf displays to be mounted at an angle which permits customers to view the liquid crystal displays easily. In one known prior art electronic shelf display mounting arrangement, electronic shelf displays have upper and lower mounting legs of different lengths. This permits the electronic shelf displays to be mounted to a showcase shelf turned upside down, thus permitting mounting of the electronic shelf displays at the desired one of two possible mounting angles.

However, many electronic shelf display systems utilize wireless communication to transmit data to and receive data from the individual electronic shelf displays. In order to optimize the transmission and reception of data with such wireless radio communication systems, it is often necessary to mount the electronic shelf displays at a predetermined angle relative to the data transmitter-receiver. In addition, it is desirable to mount the electronic shelf displays at an angle which allows the liquid crystal displays to be easily viewed by customers. While the previously described prior art electronic shelf display mounting arrangement permits selection between two mounting angles, in the case of many wireless data communication systems, it is desirable to provide a greater range of mounting angles to optimize the transmission of data to and the reception of data from each individual electronic shelf display.

Furthermore, since the electronic shelf display indicates the product price and other product information about a particular product to customers, it is desirable for the product and the corresponding electronic shelf display to be in close proximity with each other. In order to preclude customers from removing or changing the position of the electronic shelf displays once installed, it is desirable to have electronic shelf displays which preclude unauthorized removal. On the other hand, in a big retail store or similar environment, the number of products carried is large and in some cases up to several ten thousands or more electronic shelf displays are used, so it is desirable to provide a mounting arrangement which permits electronic shelf displays to be mounted on showcase shelves easily.

Accordingly, an object of the present invention is the provision of shelf mounting arrangements for electronic shelf displays or similar articles which permit electronic shelf displays to be easily mounted on showcase shelves or similar surfaces while deterring subsequent unauthorized removal of the electronic shelf displays.

Another object of the present invention is to provide shelf mounting arrangements for electronic shelf displays or similar articles which provide an increased degree of freedom in selection of and mounting of the electronic shelf displays in desired mounting angles, while deterring subsequent unauthorized changing of the electronic shelf display mounting angle.

These and other objects of the present invention are attained by the provision of shelf mounting arrangements for electronic shelf displays including a electronic shelf display mounting device for mounting the electronic shelf displays onto showcase shelves and similar surfaces. The electronic shelf display mounting device generally includes a shelf mounting member and an electronic shelf display mounting member. The shelf mounting member preferably includes a pair of upper and lower mounting legs, an engaging portion having a plurality of slits formed at different angles and a fixing portion for fixing the mounting legs to the shelf. The electronic shelf display mounting member preferably includes a connecting portion having engaging projections for engagement with the appropriate slits in the shelf mounting member and an electronic shelf display mounting portion for fixing the electronic shelf displays in position. The electronic shelf display mounting member is connected and fixed to the shelf mounting member by fitting the engaging projections into the corresponding slits formed in the shelf mounting member to provide the desired angle of elevation of the electronic shelf display. This angle of elevation may be readily changed by changing the corresponding slits of the shelf mounting member into which the engaging projections of the electronic shelf display mounting member are inserted.

Furthermore, in accordance with a preferred embodiment of the present invention, the shelf mounting member has a pair of upper and lower mounting legs of different lengths so the shelf mounting member is capable of being turned over at the time of mounting the shelf mounting member to the shelf to provide additional elevational angles for mounting the electronic shelf displays to the shelves. In another preferred embodiment of the present invention, a rail mounting member is mounted to the shelf mounting member instead of the above-described electronic shelf display mounting member to permit a plurality of electronic shelf displays to be mounted onto a single rail mounting member.

Thus, the shelf mounting arrangements for electronic shelf displays or similar articles in accordance with certain preferred embodiments of the present invention are constructed such that the projections of the electronic shelf display mounting member can be selectively fitted into slits of different angles on the shelf mounting member, thereby permitting electronic shelf displays to be mounted at various elevational mounting angles.

In addition, the shelf mounting arrangements for electronic shelf displays or similar articles in accordance with certain preferred embodiments of the present invention are constructed such that the shelf mounting member has upper and lower mounting legs of different lengths which can be mounted in either the "up" or "down" direction, such that two elevational mounting angles can be chosen for each set of slits. Consequently, it is possible to double the number of potential elevational mounting angles which may be selected.

Such shelf mounting arrangements for electronic shelf displays or similar articles permit easy mounting of the electronic shelf displays to showcase shelves and similar surfaces while at the same time precluding subsequent removal by customers and other unauthorized individuals. Furthermore, by using a mounting rail which permits the mounting of a plurality of electronic shelf displays thereon, the mounting of a plurality of electronic shelf displays is accomplished more easily. In addition, the use of the mounting rail provides a flat front end for the showcase which makes it easier to display products on and remove products from the showcase shelves.

BRIEF DESCRIPTION OF THE DRAWINGS

FIG. 3 is an enlarged perspective view of an electronic shelf display mounting device in accordance with the first preferred embodiment of a shelf mounting arrangement for electronic shelf displays or similar articles as shown in FIG. 1 showing the coupled state of a shelf mounting member and an electronic shelf display mounting member.

FIG. 5 is a partially enlarged perspective view of an electronic shelf display mounting device in accordance with the first preferred embodiment of a shelf mounting arrangement for electronic shelf displays or similar articles as shown in FIG. 1 showing a method of separating the shelf mounting member from the electronic shelf display mounting member using a special tool.

FIG. 7 is a side view of the electronic shelf display mounting device in accordance with the first preferred embodiment of a shelf mounting arrangement for electronic shelf display or similar article as shown in FIG. 1 showing the capability of mounting the electronic shelf display at different elevational mounting angles.

FIG. 8 is a side view of the electronic shelf display mounting device in accordance with the second preferred embodiment of a shelf mounting arrangement for electronic shelf display or similar article as shown in FIG. 6 showing the capability of mounting the electronic shelf display at different elevational mounting angles.

DETAILED DESCRIPTION OF THE DRAWINGS

Figure 1:
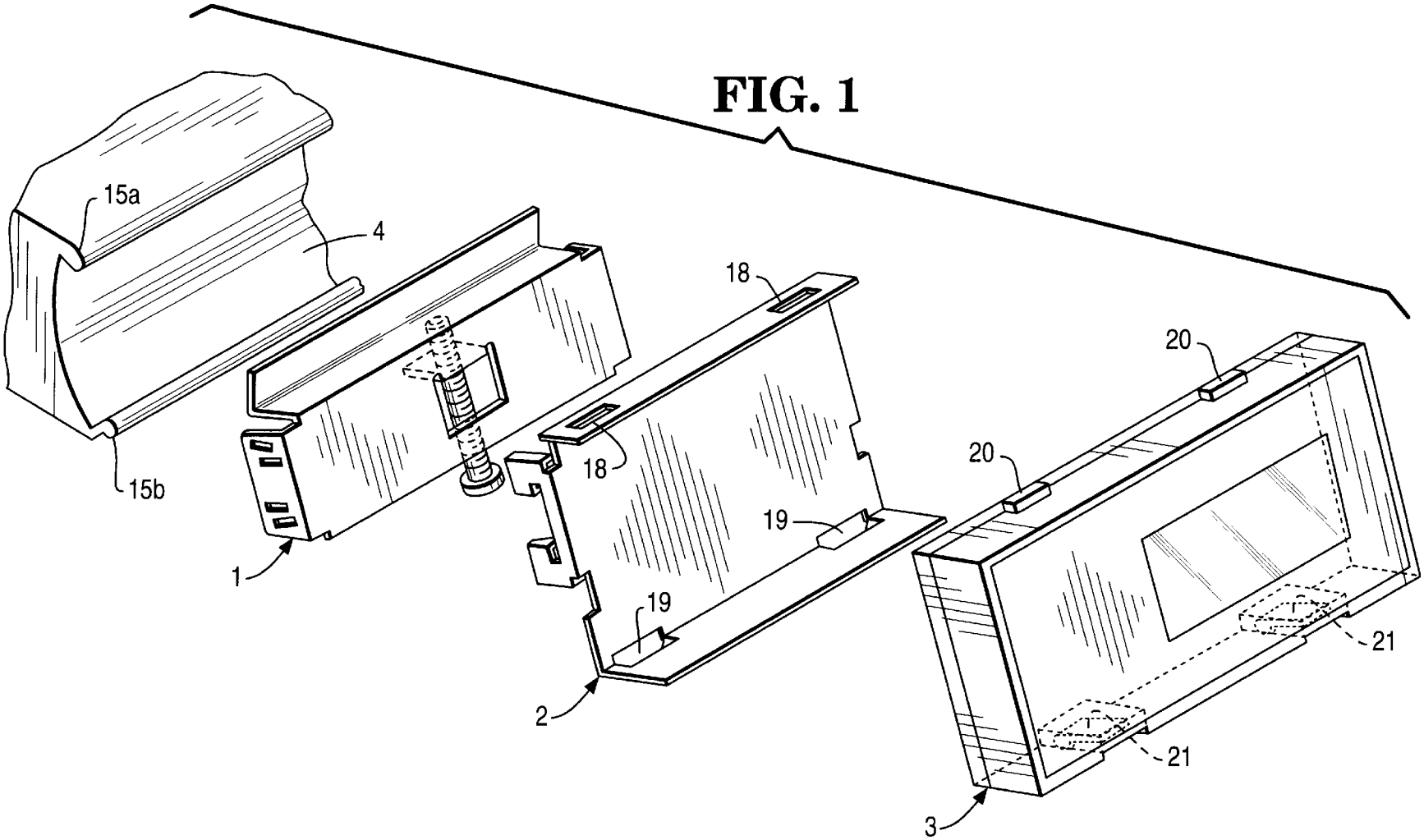
FIG. 1 illustrates an exploded perspective view of a shelf mounting arrangement for electronic shelf displays or similar articles showing the construction of an electronic shelf display mounting device in accordance a first preferred embodiment of the present invention.

Referring now to the drawings, in which like-referenced characters indicate corresponding elements throughout the several views, attention is first drawn to FIG. 1 which illustrates a first preferred embodiment of an electronic shelf display mounting device for use in connection with shelf mounting arrangements for electronic shelf displays or similar articles in accordance with the present invention. This first preferred embodiment of an electronic shelf display mounting device generally includes shelf mounting member 1, electronic shelf display mounting member 2, electronic shelf display 3 and front end 4 of a representative showcase shelf or similar surface. To mount electronic shelf display 3 to front end 4 of the representative showcase shelf or similar surface, shelf mounting member 1 is first connected to front end 4. Next, electronic shelf display mounting member 2 is mounted onto shelf mounting member 1. Electronic shelf display 3 is then mounted onto electronic shelf display mounting member 2, thereby fixing electronic shelf display 3 to the showcase shelf.

Figure 2:
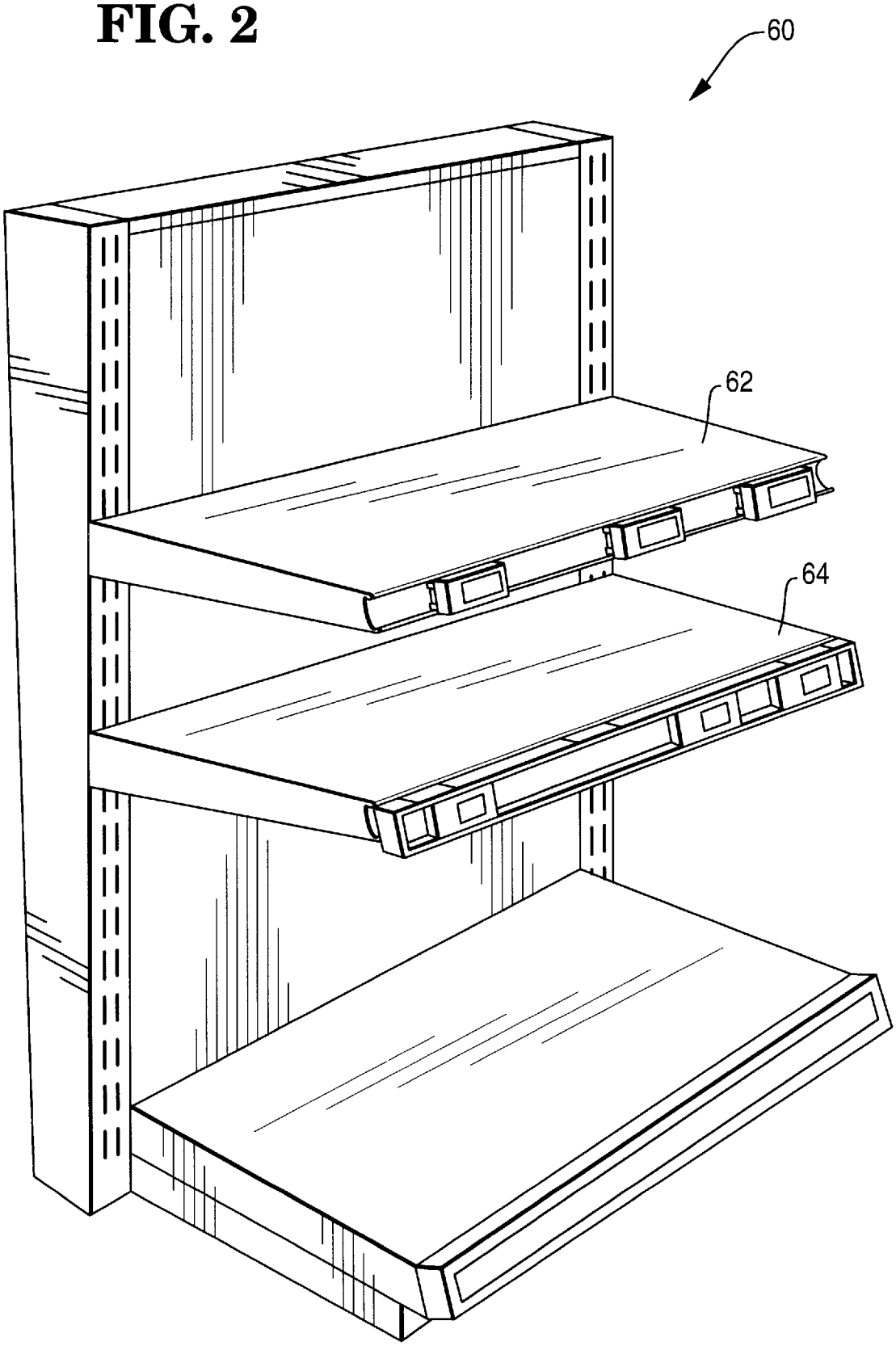
FIG. 2 is a perspective view of the shelf mounting arrangement for electronic shelf displays or similar articles shown in FIG. 1 showing the first preferred embodiment of the electronic shelf display mounting device where electronic shelf displays have been individually mounted to a showcase shelf in accordance with the present invention and a second preferred embodiment of the electronic shelf display mounting device where a plurality of electronic shelf displays have been jointly mounted to a showcase shelf in accordance with the present invention.

FIG. 2 shows a mounted state of electronic shelf displays to showcase 60 using electronic shelf display mounting devices in accordance with the present invention. More specifically, shown is a mounted state of electronic price displays to display stand 62 of showcase 60 using an electronic shelf mounting device in accordance with the first preferred embodiment of the present invention and a mounted state of electronic price displays to display stand 64 of showcase 60 using an electronic shelf mounting device in accordance with a second preferred embodiment of the present invention.

Figure 4:
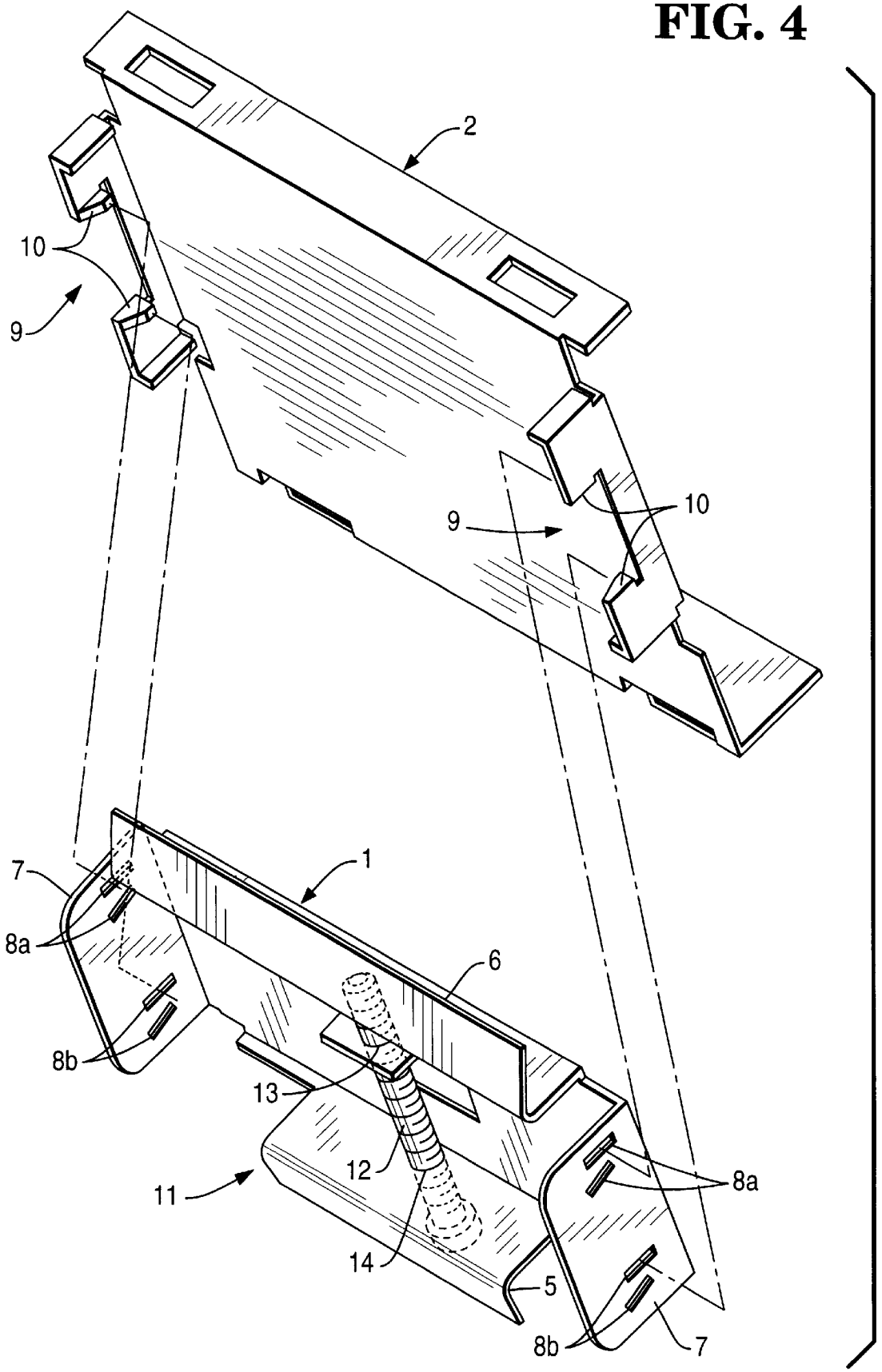
FIG. 4 is a perspective view of the electronic shelf display mounting device in accordance with the first preferred embodiment of a shelf mounting arrangement for electronic shelf displays or similar articles as shown in FIG. 1 showing the shelf mounting member and the electronic shelf display mounting member in a separated state.

Referring now to FIGS. 3 and 4, the structure of shelf mounting member 1 and electronic shelf display mounting member 2 will be described. FIG. 3 is an enlarged perspective view showing a coupled state of shelf mounting member 1 and electronic shelf display mounting member 2 and FIG. 4 is an enlarged perspective view showing shelf mounting member 1 and electronic shelf display mounting member 2 separated from each other.

Shelf mounting member 1 preferably has two mounting legs 5 and 6 of different lengths and two engaging portions 7 for mounting electronic shelf display mounting member 2. Two pair of slits 8*a* and 8*b* are formed in each engaging portion 7. Two upper and lower slits 8*a* and 8*b*, each extending in parallel, make a pair for engagement with electronic shelf display mounting member 2, and the four slits constitute two pairs of slits 8*a* and 8*b* of different angles. Although in this embodiment two sets of slits, a total of four slits, are formed in each engaging portion 7, if desired, six or more slits may be formed in each engaging portion 7. Shelf mounting member 1 is further provided with fixing portion 11 for fixing mounting legs 5 and 6 to front end 4 of the representative showcase or similar article. Fixing portion 11 includes male screw member 12, screw guide member 13 and internally threaded hole 14 formed in one mounting leg 5. After mounting legs 5 and 6 are disposed at front end 4 of the representative showcase or similar surface, male screw member 12 of fixing portion 11 is rotated. This forces the front end of male screw member 12 against mounting leg 6 to widen the spacing between mounting legs 5 and 6, whereby front ends of mounting legs 5 and 6 are fixed to both edges 15*a* and 15*b* of front end 4 of the representative showcase or similar surface. It is optional which of mounting legs 5 and 6 are to be positioned up relative to front end 4 of the representative showcase or similar surface.

Electronic shelf display mounting member 2 has two connecting portions 9 which correspond to the two engaging portions 7 of shelf mounting member 1. Each connecting portion 9 has two projections 10 capable of being fitted into either pair of slits 8*a* or 8*b* formed in engaging portions 7 of shelf mounting member 1. Each projection 10 preferably has an oblique shape so that when electronic shelf display mounting member 2 is pushed in from behind with respect to shelf mounting member 1, projections 10 can be easily fitted into slits 8*a* or 8*b* of the two right and left engaging portions 7. Connecting portions 9 have sufficient elasticity in the right and left direction so that, at the time of mounting, connecting portions 9 widen gradually to the right and left and thereafter projections 10 come into engagement with the corresponding pair of slits 8*a* or 8*b*. Thus, mounting of electronic shelf display 3 to front end 4 of the representative showcase or similar surface is readily accomplished, and once attachment is made, unauthorized subsequent removal of electronic shelf display 3 is difficult. This precludes customers and other unauthorized individuals from removing or shifting the position of electronic shelf displays 3 once installed. However, when removal or shifting of electronic shelf displays 3 is necessary, separation of electronic shelf display mounting member 2 and shelf mounting member 1 from each other is readily accomplished using detaching tool 16 as shown in FIG. 5. Since projections 10 of connecting portions 9 have an oblique shape, plate member 17 of detaching tool 16 can be inserted under pressure between engaging portions 7 of shelf mounting member 1 and connecting portions 9 of electronic shelf display mounting member 2, as shown in FIG. 5. Thus, connecting portions 9 are widened to the right and left to permit separation of shelf mounting member 1 and electronic shelf display mounting member 2 from each other.

The method of mounting electronic shelf display 3 to front end 4 of the representative showcase or similar surface using shelf mounting member 1 and electronic shelf display mounting member 2 will now be described. As seen in FIG. 1, electronic shelf display mounting member 2 has two engaging holes 18 in upper positions and two latch holes 19 in lower positions. On the other hand, electronic shelf display 3 has two projections 20 in upper positions and two latch members 21 in lower positions. In an engaged state, projections 20 of electronic shelf display 3 couple with engaging holes 18 of electronic price display mounting member 2 and push against latch members 21 having elasticity. Electronic shelf display 3 is inserted until latch members 21 come into engagement with latch holes 19, whereby the mounting of electronic shelf display 3 is complete. Latch holes 19 are preferably in the form of a depression so as not to permit a customer or other unauthorized individual to push in the pawls of latch members 21 and remove electronic shelf display 3 from front end 4 of the representative showcase or similar surface.

Figure 6:
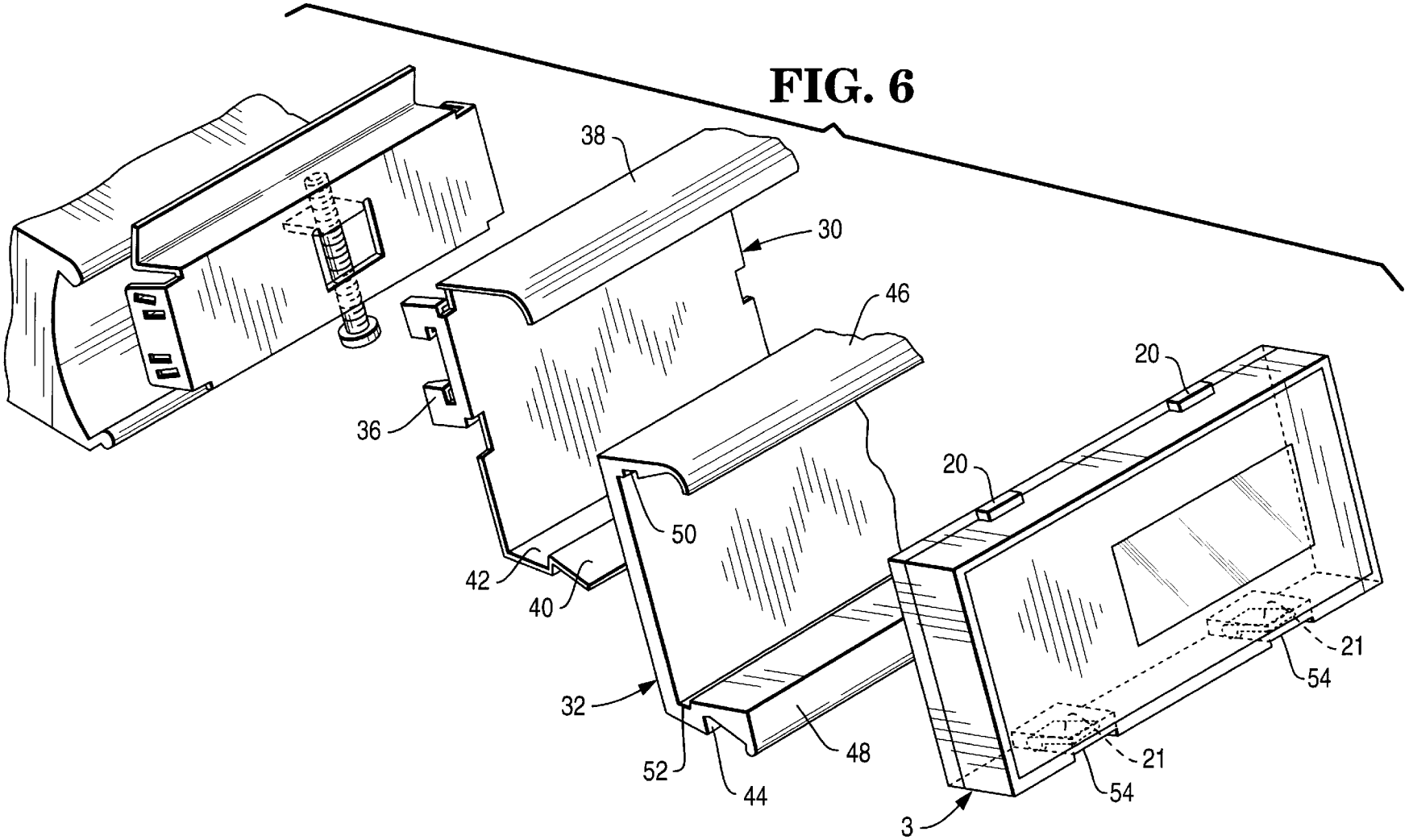
FIG. 6 is an exploded perspective view of a second preferred embodiment of a shelf mounting arrangement for electronic shelf displays or similar articles showing the construction of an electronic shelf display mounting device in accordance with the present invention.

Referring now to FIG. 6, a second preferred embodiment of an electronic shelf display mounting device for shelf mounting arrangements for electronic shelf displays or similar articles will now be described. The second preferred embodiment of electronic shelf display mounting device is similar to the first preferred embodiment of electronic shelf display mounting device shown in FIG. 1, except rail mounting member 30 and electronic shelf display mounting rail 32 are used instead of electronic shelf display mounting member 2.

Referring now to FIG. 2, the external appearance of showcase 60 with a plurality of electronic shelf displays mounted thereto using the second preferred embodiment of electronic shelf display mounting device is shown on display stand 64. It can be seen from FIG. 6 that multiple electronic shelf displays 3 can be mounted to a single electronic shelf display mounting rail 32.

The construction of rail mounting member 30 is similar to the construction of electronic shelf display mounting member 2. In particular, connection portions 36 for mounting rail mounting member to shelf mounting member 1 may be similar to connecting portions 9 of electronic shelf display mounting member 2 as described in connection with the first preferred embodiment of electronic shelf display mounting device. Upper guide 38 and lower guide 40, both for holding rail 32, have an elastic force whereby rail 32 is held after mounting thereof. Rail 32, once mounted, cannot be detached because of the presence of both a stepped part 42 of lower guide 40 of rail mounting member 30 and engaging stepped part 44 of rail 32. The number of rail mounting members 30 used differs depending on the length of rail 32.

The operation for mounting electronic shelf display 3 using the second preferred embodiment of electronic shelf display mounting device in accordance with the present invention will now be described. At the time of mounting electronic shelf display 3, upper and lower fixing guides 46 and 48 of rail 32 expand up and down because they have an elastic force. When electronic shelf display 3 is attached to the inner part, upper projections 20 of electronic shelf display 3 come into engagement with upper engaging groove 50 of rail 32, while latch members 21 engage lower engaging groove 52, whereby it is made possible to mount electronic shelf display 3 in any desired position on rail 32. The removal of electronic shelf display 3 is accomplished by inserting a plate-like electronic shelf display detaching tool (not shown) into holes 54 formed in the lower portions of latch members 21. Upon insertion of the detaching tool, latch members 21 are pushed upwardly to release the latched state.

FIG. 7 is a side view showing various elevational mounting angles in the case of mounting electronic shelf displays 3 using the electronic shelf display mounting device in accordance with the first preferred embodiment of the present invention. FIG. 7(A) shows a mounted state of shelf mounting member 1 to front end 4 of a representative showcase or similar article, with the shorter of the two mounting legs, mounting leg 5 positioned upwardly, in which slits 8*a* and 8*b* of engaging portions 7 are changed from one set to the other. FIG. 7(B) shows a mounted state of shelf mounting member to front end 4 of a representative showcase or similar article, with the longer of the two mounting legs, mounting leg 6 positioned upwardly, in which slits 8*a* and 8*b* of engaging portions 7 are changed from one set to the other. As seen in these Figures, it is thus possible to mount electronic shelf display at four different elevational mounting angles.

FIG. 8 is a side view showing a mounted state of electronic shelf display 3 using the electronic shelf display mounting device in accordance with the second preferred embodiment of the present invention. While only a mounted state with the shorter of the two mounting legs, mounting leg 5, positioned upwardly is shown, it can be readily seen that three other elevational mounting angles can be utilized by combining the position of mounting legs 5 and 6, along with the selection of the set of slits 8*a* and 8*b* as described above in connection with FIG. 7.

In the present invention, as described above, projections 10 of electronic shelf display 3 are selectively fitted into slits

8*a* and 8*b* of different angles, such that it is made possible to mount electronic shelf display 3 at various elevational mounting angles. As a result, it is possible to choose a suitable elevational mounting angle out of the various elevational mounting angles available from both the standpoint of mounting electronic shelf display 3 at an appropriate angle relative to the transmitter-receiver, as well as from the standpoint of permitting customers to view the product price and other product information displayed on the liquid crystal display of electronic shelf display 3 easily. On the other hand, since such suitable elevational mounting angle is determined by choosing the appropriate set of slits 8*a* and 8*b*, the unauthorized changing of the elevational mounting angle of electronic shelf display 3 is difficult, thus making it possible to preclude subsequent changing of the position and/or removal of electronic shelf display 3 by customers or other unauthorized individuals.

According to the present invention, in addition to the above described construction, upper and lower mounting legs 5 and 6 of shelf mounting member 1 have different lengths and can be turned upside down, whereby it is made possible to choose two elevational mounting angles for each position of slits 8*a* and 8*b*. Consequently, it is made possible to double the elevational mounting angle selection range.

Moreover, the double structure including shelf mounting member 1 and electronic shelf display mounting member 2 permits easy mounting to front edge 4 of a representative showcase shelf or similar surface, and deters unauthorized detachment. Furthermore, when the mounting rail which permits mounting of multiple electronic shelf displays thereto is used, it becomes easier to mount multiple electronic shelf displays. Additionally, the use of the mounting rail provides a flat front end of the showcase. This is effective in reducing inconveniences caused by the projection of electronic shelf displays from the front end of the showcase, for example the inconvenience of a product or a customer's arm being inadvertently hooked on an electronic shelf display at the time of display or upon removal of the product from the showcase shelf. It will be appreciated that other variations and configurations will become readily apparent to one having ordinary skill in the relevant art by following the teachings of the present invention.

Although the present invention has been described above in detail, the same is by way of illustration and example only and is not to be taken as a limitation on the present invention. For, example, the number of sets of slits present in each of the engaging portions of the shelf mounting member could be three or more to provide for an even greater selection of electronic shelf display elevational mounting angles. Accordingly, the scope and content of the present invention are to be defined only by the terms of the appended claims.

What is claimed is:

1. An electronic shelf display mounting device for mounting an electronic shelf display to a showcase shelf, said electronic shelf display mounting device comprising a shelf mounting member and an electronic shelf display mounting member:

said shelf mounting member including a first mounting leg, a second mounting leg, a fixing portion for fixing said first mounting leg and said second mounting leg to said showcase shelf and a pair of engaging portions, each of said engaging portions having more than one set of slits formed at different angles;

said electronic shelf display mounting member having an electronic shelf display fixing portion for fixing said electronic shelf display in a snap-in fashion and a pair of connecting portions, each of said connecting portions having projections, said projections having an oblique shape relative to said connecting portions and selectively fitting into only one of said sets of slits;

in which at the time of mounting and fixing said electronic shelf display mounting member to said shelf mounting member, a mounting angle of the electronic shelf display to be mounted and fixed to said electronic shelf display mounting member relative to the showcase shelf, is selected by selecting said one of said sets of slits into which said projections are fitted and wherein the mounting angle can not be changed without removing said electronic display mounting member from said shelf mounting member.

2. The electronic shelf display mounting device of claim 1 wherein said fixing portion further includes:

a male screw member;

a screw guide; and an internally threaded hole wherein rotation of said male screw member widens space between said first mounting leg and said second mounting leg to secure said shelf mounting member to said showcase shelf or similar surface.

3. An electronic shelf display mounting device for mounting an electronic shelf display to a showcase shelf, said electronic shelf display mounting device comprising a shelf mounting member and an electronic shelf display mounting member:

said shelf mounting member including an engaging portion having more than one set of slits formed at different angles, a first mounting leg and a second mounting leg, said first mounting leg being longer than said second mounting leg, and a fixing portion capable of fixing said first mounting leg and said second mounting leg to the showcase shelf so as to permit said first mounting leg to be mounted as either an upper leg or a lower leg to provide two different elevational angles at which said shelf mounting member is mounted relative to the showcase shelf;

said electronic shelf display mounting member including an electronic shelf display fixing portion for fixing the electronic shelf display in a snap-in fashion and a pair of connecting portions, each of said connecting portions having projections, said projections having an oblique shape relative to said connecting portions and selectively fitting into only one of said sets of slits; and in which a mounting angle of the electronic shelf display to be mounted and fixed relative to the showcase shelf is selected by selecting an elevational angle of said shelf mounting member with respect to the showcase shelf and by selecting one of said sets of slits into which said projections are fitted.

4. An electronic shelf display mounting device for mounting an electronic shelf display to a showcase shelf, said electronic shelf display mounting device comprising a shelf mounting member for mounting the electronic shelf display to the showcase shelf, a rail mounting member and an electronic shelf display mounting rail:

said shelf mounting member including a first mounting leg and a second mounting leg, a fixing portion for fixing said first mounting leg and said second mounting leg to the showcase shelf and an engaging portion having more than one set of slits formed at different angles;

said electronic shelf display mounting rail including a plurality of electronic shelf display fixing portions capable of fixing the electronic shelf displays in a snap-in fashion and a mounting portion mounted to and fixed to said rail mounting member; and said rail mounting member having a pair of connecting portions, each of said connecting portions having projections, said projections having an oblique shape relative to said connecting portions and selectively fitting into only one of said sets of slits;

in which a mounting angle of the electronic shelf displays to be mounted and fixed to said rail mounting member relative to the showcase shelf is selected by selecting one of said sets of slits of said shelf mounting member into which said projections of said rail mounting member are fitted and wherein the mounting angle can not be changed without removing said rail mounting member from said shelf mounting member.

5. An electronic shelf display mounting device for mounting an electronic shelf display to a showcase shelf, said electronic shelf display mounting device comprising a shelf mounting member for mounting the electronic shelf display to the showcase shelf, a rail mounting member and an electronic shelf display mounting rail:

said shelf mounting member including an engaging portion having more than one set of slits formed at different angles, a first mounting leg and a second mounting leg, said first mounting leg being longer than said second mounting leg, and a fixing portion capable of fixing said first mounting leg and said second mounting leg to the showcase shelf so as to permit said first mounting leg to be mounted as either an upper leg or a lower leg to provide two different elevational angles at which said shelf mounting member is mounted relative to the showcase shelf;

said rail mounting member including a rail fixing portion for fixing said electronic shelf display mounting rail and a connecting portion having projections, said projections having an oblique shape relative to said connecting portions and selectively fitting into only one of said sets of slits; and said electronic shelf display mounting rail including a plurality of electronic shelf display fixing portions capable of fixing the electronic shelf displays in a snap-in fashion and a mounting portion mounted to said rail mounting member;

in which a mounting angle of a plurality of the electronic shelf displays to be mounted to the showcase shelf can be selected by selecting one of said sets of slits of said shelf mounting member to fit said projections of said rail mounting member and by selecting an elevational angle of said shelf mounting member with respect to the showcase shelf.

* * * * *